United States Patent [19]

Mears

[11] 4,100,366

[45] Jul. 11, 1978

[54] METHOD AND APPARATUS FOR COOLING ELECTRICAL APPARATUS USING VAPOR LIFT PUMP

[75] Inventor: Whitney Harris Mears, Amherst, N.Y.

[73] Assignee: Allied Chemical Corporation, Morris Township, Morris County, N.J.

[21] Appl. No.: 754,858

[22] Filed: Dec. 27, 1976

[51] Int. Cl.[2] ..... H01E 27/10

[52] U.S. Cl. ..... 174/15 R; 165/105; 174/16 R; 336/57

[58] Field of Search ..... 174/15 R, 14 R, 16 R; 165/105; 417/134, 135, 136, 138, 208, 209; 336/55, 57, 58, 61

[56] References Cited

U.S. PATENT DOCUMENTS

| | | | |
|---|---|---|---|
| 3,444,308 | 5/1969 | Narbut | 174/15 R |
| 3,887,759 | 6/1975 | Staub et al. | 174/15 R |
| 4,011,535 | 3/1977 | Kosky et al. | 174/15 R |

*Primary Examiner*—Arthur T. Grimley

*Attorney, Agent, or Firm*—Alan M. Doernberg; Jay P. Friedenson

[57] ABSTRACT

An electrical apparatus having a casing with an electrical conductor disposed therein and a vapor lift pump for applying a vaporizable liquid coolant to the electrical conductor to effect cooling of electrical conductor by vaporization of the applied liquid coolant. A non-condensable gas acts as a padding gas at low temperatures and is circulated through the vapor lift pump from a gaseous inlet. The vaporizable liquid is driven by the non-condensable gas onto the electrical conductor, vaporizes, recondenses on the casing wall and returns to a reservoir where it is again picked up by the non-condensable gas.

4 Claims, 1 Drawing Figure

METHOD AND APPARATUS FOR COOLING ELECTRICAL APPARATUS USING VAPOR LIFT PUMP

BACKGROUND OF THE INVENTION

This invention relates to splash coolants for high voltage-high power electrical equipment.

A transformer apparatus is known, including an enclosed electrical apparatus utilizing a relatively small amount of liquid fluorocarbon which is sprayed in a thin layer over the electrical windings to cool them by evaporation of the fluorocarbon, the fluorocarbon vapors constituting at least a part of the electrically insulating gas atmosphere. Such an apparatus is disclosed in U.S. Pat. No. 2,561,738.

Systems are known, including a non-condensable dielectric gas added to such systems as a padding gas to provide added electrical insulation at low temperatures, particularly when the transformer is first turned on or is restarted after the liquid has cooled. Such systems are disclosed in U.S. Pat. Nos. 3,444,308, 3,452,147, 3,023,263 and 3,243,495. In each of these prior art devices, the vaporizable liquid is circulated independently by a liquid pump or the like. As a result, at operating temperatures, the non-condensable gas will accumulate around the top of the apparatus and block the diffusion or migration of the vaporized liquid from the transformer coils to the casing walls. Various complex systems have been developed for removing the non-condensable gas from the system once operating temperatures are achieved, as by a separation plant in U.S. Pat. No. 3,243,495 and separate cooler units with associated structures in U.S. Pat. Nos. 3,444,308 and 3,452,147. Such systems unduly complicate the operation of the coolant systems and sometimes lower the casing wall surface area to which the vaporized liquid may quickly migrate and be condensed.

U.S. Pat. No. 3,417,814 discloses an electrical apparatus submerged in coolant liquids. Such submersion systems would be unsuitable for transformers and the like where high dielectric strength, and thus high electrical insulation, is required.

BRIEF DESCRIPTION OF THE INVENTION

The invention includes an improvement in an electrical apparatus having a casing with an electrical conductor disposed therein which is subject to temperature changes when in use, said casing being adapted to contain a non-condensable gas and a vaporizable liquid coolant, means for applying liquid coolant to the electrical conductor to effect cooling of the electrical conductor by vaporization of the applied liquid coolant, said casing being adapted to permit the vapors of the liquid coolant and the non-condensable gas to intermix within the casing when the vapors evolve to provide a dielectric medium for insulating the electrical conductor. In the improvement, the means for applying a liquid coolant to the electrical conductor includes a reservor for condensed liquid coolant and a vapor lift pump having (1) a liquid inlet in said reservoir, (2) a gaseous inlet adjacent the top of the casing and (3) an outlet over said electrical conductor.

The invention also includes a method of cooling an electrical apparatus comprising surrounding the electrical apparatus with a non-condensable gas having high dielectric strength, selectively splashing a vaporizable liquid coolant onto the electrical apparatus by circulating the non-condensable gas to drive the vaporizable liquid, permitting the vaporizable liquid to evaporate off the electrical apparatus and diffuse to the walls of a casing around the electrical apparatus and permitting the vaporizable gas to recondense on the casing walls and return to the reservoir.

DETAILED DESCRIPTION OF THE INVENTION

Figure 1:
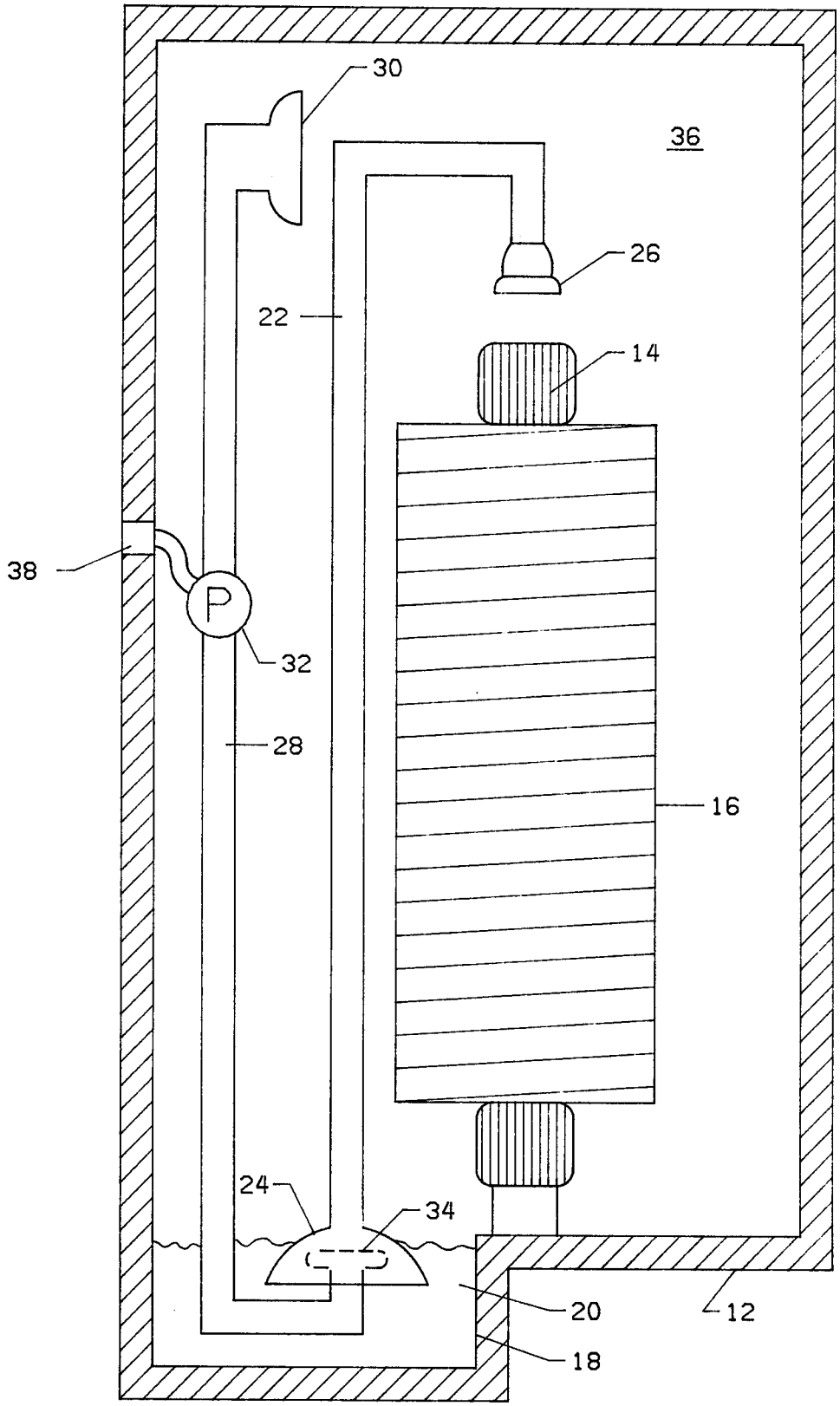

With reference to FIG. 1, transformer 10 as illustrated comprises a sealed casing 12 within which is disposed a magnetic core 14 and electrical windings 16 associated therewith supported on the bottom of the casing. For purposes of simplifying the drawing, leads to the winding 16 and the bushings normally carried by the top or cover of the casing 12 are not shown.

As illustrated in FIG. 1, the bottom of the casing 12 is provided with a sump or reservoir 18 in which there is disposed a supply 20 of vaporizable liquid coolant. The supply 20 of the liquid coolant is relatively small as compared to the size of casing 12.

A vapor lift pump is provided including a first hollow vertical tube 22 having a lower inlet 24 and an upper outlet 26. The vapor lift pump also includes a second vertically-disposed tube 28 provided with an upper inlet 30 and a lower outlet 32. The second vertically-disposed tube 28 is also centrally provided with a gaseous pump or other conveying means 32. The lower outlet 34 of the record tube 28 is received within the lower inlet 24 of the first tube 22 below the surface of the supply 20 of liquid in the reservoir 18.

In operation, the transformer 10 is connected and begins to heat up. At this point, a non-condensable gas 36 provides the major portion of the atmosphere around the transformer. It operates as a padding gas so as to provide sufficient electrically insulation for the transformer 10. As the temperature increases, the gas pump 32 is activated by a thermo control 38 which is set at a preset tempreature or temperatures to activate or differentially regulate the gas pump 32, so as to withdraw non-condensable gas 36 from the upper space within the casing 12 through the upper inlet 30. The non-condensable gas 36 is conveyed downward through the second vertically-disposed tube 28 and out the lower outlet 34. Acting like a coffee percolator, the bubbles of non-condensable gas 36, within the lower inlet 24, rise upwardly through the vertical tube 22 and out the upper outlet 26. In doing so, the non-condensable gas 36 bubbles drive amounts of the vaporizable liquid upward through the vertical tube 22 and out the upper outlet 26 onto the magnetic core 14. The vaporizable liquid vaporizes and absorbs the excess heat of the magnetic cord 14 and diffuses to the casing 12. The vaporizable liquid condenses on the casing 12, releasing the absorbed heat, and flows down the casing walls 12 back to the reservoir 18. Thus, upper inlet 30 acts as a gaseous inlet, lower inlet 24 acts as a liquid inlet and upper outlet 26 acts as an outlet for the vapor lift pump.

It should be appreciated that any of the vaporizable liquid disclosed in U.S. Pat. Nos. 2,561,738 or 2,875,263, and particularly the fluorocarbons disclosed therein, may be used as the supply of vaporizable liquid 20. Preferred materials include $C_2Cl_3F_3$ (B.P. 47.6° C);

$$\underbrace{CF_2CF_2CFOCFO}$$

(B.P. 59.9° C); $(C_4F_9)_3N$ (B.P. 174);

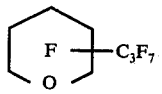

(B.P. 102° C); $(CF_3)_2CFO(C_2F_4)_2C_2F_5$ (B.P. 121° C). It should also be appreciated that the non-condensable gas 36 may be any of a variety of materials with sufficient dielectric strength and vapor pressure at both start-up and operating conditions. Examples include $SF_6$ alone or in blends; $CClF_3$; $SF_6$ with $CO_2$; $SF_6$ with $CO_2$ and $CCl_2F_2$; $C_2F_6$ and $CO_2$ and $SF_6$ and $N_2$. Sulfur hexafluoride is preferred. It should also be appreciated that, by withdrawing non-condensable gas 36 near the top of the casing through the top inlet 30, a pressure differential is developed which enhances the diffusion of the vaporized liquid to the casing walls 12. While it is possible that a certain portion of the vaporized liquid will also be drawn into the upper inlet 30, this provides no handicap in that such vaporized liquid would be condensed in the reservoir 18 before being sprayed onto the magnetic coil 14 through the upper outlet 26.

It should be appreciated that, by operation according to the present invention, the non-condensable gas acts as a padding gas at low temperatures and enhances circulation of vaporizable liquid through the system at higher operating temperatures. Because of the thermo control of the gaseous pump 32, and because the vaporizable liquid will be entirely condensed in the reservoir at low temperatures, there is no need to provide any complex structure to separate the non-condensable gas from the vaporizable liquid.

I claim:

1. In an electrical apparatus having a casing with an electrical conductor disposed therein which is subject to temperature changes when in use, said casing being adapted to contain a non-condensable gas and a vaporizable liquid coolant means for applying liquid coolant to the electrical conductor to effect cooling of the electrical conductor by vaporization of the applied liquid coolant, said casing being adapted to permit the vapors of the liquid coolant and the non-condensable gas to intermix within the casing when the vapors evolve to provide a dielectric medium for insulating the electrical conductor; the improvement wherein the means for applying a liquid coolant to the electrical conductor includes a reservoir for condensed liquid coolant and a vapor lift pump having (1) a liquid inlet in said reservoir, (2) a gaseous inlet adjacent the top of the casing and (3) an outlet over said electrical conductor.

2. An electrical apparatus as claimed in claim 1 wherein said vapor lift pump includes gas conveying means for conveying said non-condensable gas through said vapor lift pump to carry liquid coolant onto the electrical conductor and regulator means for controlling the rate of flow of non-condensable gas.

3. An electrical apparatus as claimed in claim 2 wherein said regulator means is a thermostat connected to activate said gas conveying means when the temperature inside said casing exceeds a selected temperature.

4. A method of cooling an electrical apparatus comprising surrounding the electrical apparatus with a non-condensable gas having a high dielectric strength, selectively splashing a vaporizable liquid coolant onto the electrical apparatus by circulating the non-condensable gas to drive the vaporizable liquid upward, permitting the vaporizable liquid to evaporate off the electrical apparatus and diffuse to the walls of a casing around the electrical apparatus and permitting the evaporated vaporizable liquid to recondense on the casing walls and return to the reservoir.

* * * * *